United States Patent [19]

Lopez

[11] Patent Number: 4,480,819

[45] Date of Patent: Nov. 6, 1984

[54] ATTACHABLE/DETACHABLE RAILING DEVICE

[76] Inventor: Keith Lopez, 304-½ 4th St., Abbeville, La. 70510

[21] Appl. No.: 391,293

[22] Filed: Jun. 23, 1982

[51] Int. Cl.[3] ..... E04H 17/00

[52] U.S. Cl. ..... 256/1; 256/59; 182/113

[58] Field of Search ..... 256/DIG. 6, 1, 69, 59; 403/353, 187; 182/113; 108/55.1; 52/296

[56] References Cited

U.S. PATENT DOCUMENTS

| | | | |
|---|---|---|---|
| 3,177,925 | 4/1965 | Miller | 160/114 |
| 3,406,946 | 10/1968 | Saultz | 256/DIG. 6 X |
| 3,531,091 | 9/1970 | Windham | 256/DIG. 6 X |
| 3,632,089 | 1/1972 | Smith | 256/DIG. 6 X |
| 3,858,988 | 1/1975 | Cohen | 403/187 X |
| 3,920,221 | 11/1975 | Berry | 256/59 |

*Primary Examiner*—Andrew V. Kundrat
*Attorney, Agent, or Firm*—Keaty & Keaty

[57] ABSTRACT

The present invention relates to a protective railing device having posts for supporting a barrier means and with the posts having foot portions which are attachable to the grating of an offshore platform.

11 Claims, 8 Drawing Figures

ATTACHABLE/DETACHABLE RAILING DEVICE

BACKGROUND OF THE INVENTION

1. Field of the Invention

The present invention relates to safety barriers and more particularly to safety barriers for barricading holes and other dangerous areas on oil rig platforms and the like, in order to prevent slippage of workers or objects into the holes and other dangerous areas.

2. Description of the Prior Art

There presently exist many devices somewhat similar to the present invention, but none have been successfully utilized in the context of oil operations. The main problem with applying these devices of the prior art within this context is that grating is commonly used in oil rig platforms and no means have yet been devised to facilitate convenient engagement of the rail post with the grating. The present invention teaches an attachable/detachable protective railing device which interlaces with the grating on the platform. The present invention is effective, simple to install and remove, and is inexpensive.

U.S. Pat. No. 3,177,925, entitled "Portable Adjustable Fence for Manholes, openings and the like," issued to M. Miller, teaches a collapsible fence positioned in surrounding relationship to a manhole, opening or the like, the fence being supported by a plurality of "bipods" which merely stand on the surface of the area surrounding the manhole or the like.

U.S. Pat. No. 3,632,089, entitled "Safety Barrier Post," issued to Malcolm K. Smith, teaches a Safety Barrier Post apparatus adapted for attachment, by means of a post-supporting clamp, to a concrete slab.

U.S. Pat. No. 3,406,946, entitled "Safety Rail for Concrete Building," issued to R. H. Saultz, teaches a Safety Rail bolted into a concrete balcony.

The rest of the patents are representative of what is in the prior art.

3. Summary of the Invention

The present invention teaches an attachable/detachable protective railing device which interlaces with the grating on an offshore platform to prevent workmen, objects, or the like, from falling into dangerous areas on the offshore platforms such as holes that are cut into offshore platforms to facilitate the movements of pipes, conduits, or the like.

The present invention consists of a plurality of rail posts, or poles arranged in any suitable configuration in surrounding relationship to the dangerous area on the oil rig platform. Each rail post unitarily comprises a foot portion which is channeled to engage with the grating of the platform. Each rail post is tilted in one direction and then raised to its upright position, to facilitate engagement of the foot portion of the rail post with the grating. The rail posts are then tied or otherwise connected by rope, cable or any suitable barricade means, in any suitable manner, to any number of other rail posts similarly engaged with the grating in surrounding relationship to the dangerous area. It is important to note that each rail post can be tied off in any direction except the direction in which it was titled to couple it with the grating, as this would cause the foot portion to become disengaged from the grating.

After the rail posts which are engaged with the grating in any suitable configuration in surrounding relationship to the dangerous area are connected together by any suitable barricade means, for example, tied together by cable, rope, or the like, it can easily be seen that an effective barricade around the dangerous area has been effected.

Other and more specific objects and advantages will become more readily apparent from the following detailed description when read in conjunction with the accompanying drawings which illustrates a useful embodiment of a pipe testing tool in accordance with the present invention.

DETAILED DESCRIPTION OF THE PREFERRED EMBODIMENT

Figure 1:
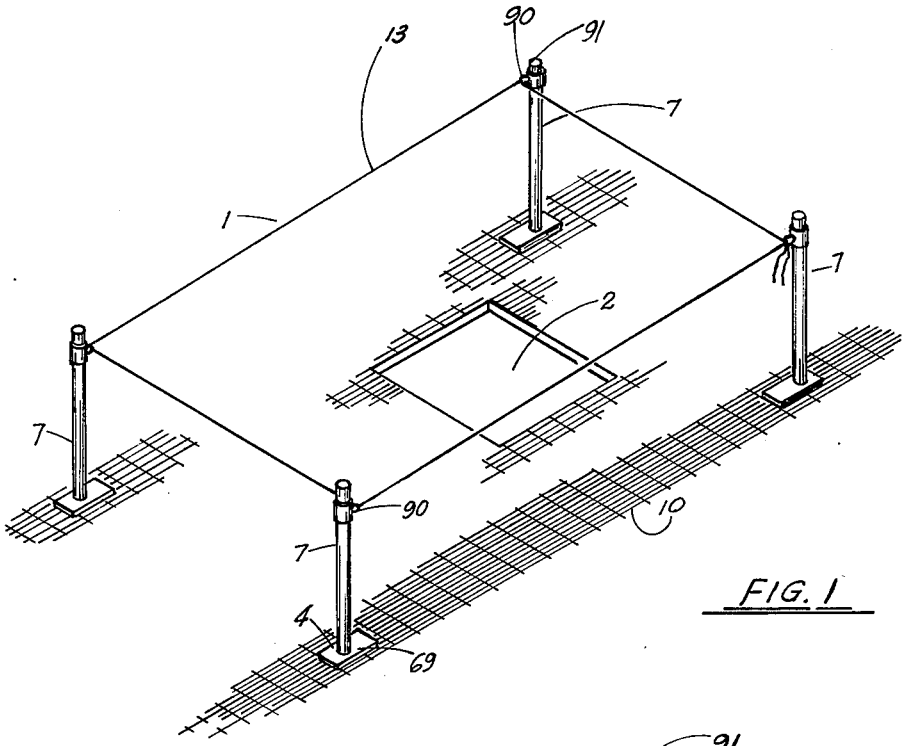
FIG. 1 is a perspective view of the apparatus of the present invention mounted to the grating of an oil rig platform.

Referring now to the drawings and particularly to FIG. 1, there can be seen the apparatus of the present invention indicated generally by numeral 1, mounted on the grating 10 of an oil rig platform (not shown) in surrounding relationship to a dangerous area, here depicted as hole 2, as holes of this nature are commonly cut into oil rig platforms to facilitate the movement of pipes, conduits, or the like therethrough.

Figure 2:
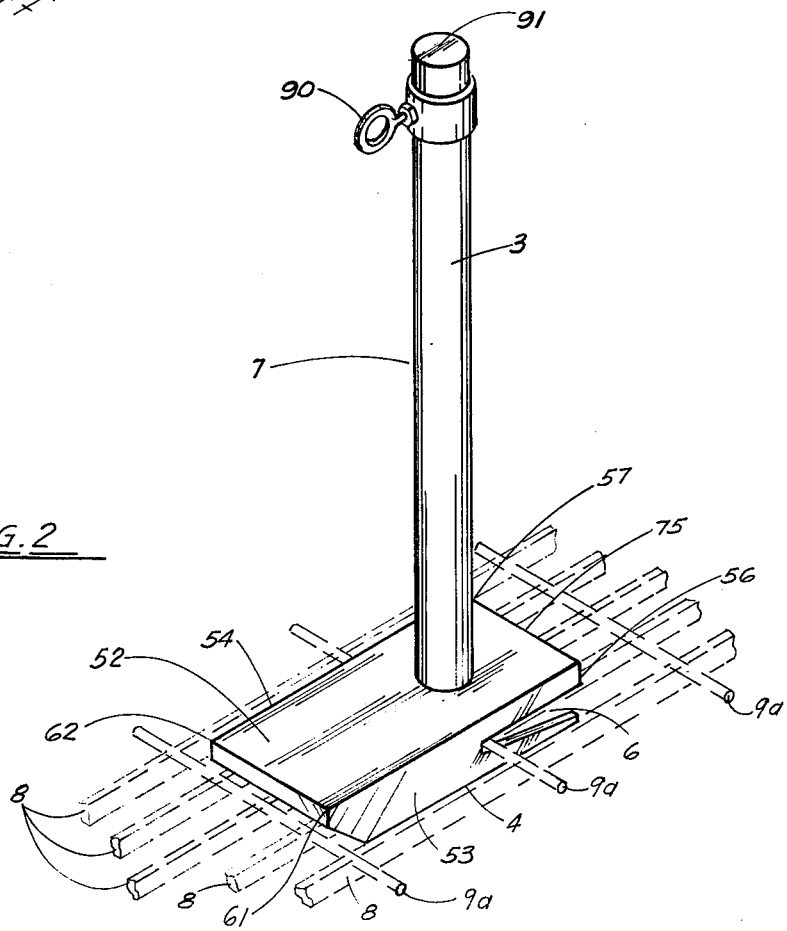
FIG. 2 is a perspective, elevational view of one of the rail post shown engaged with the grating.
Figure 5:
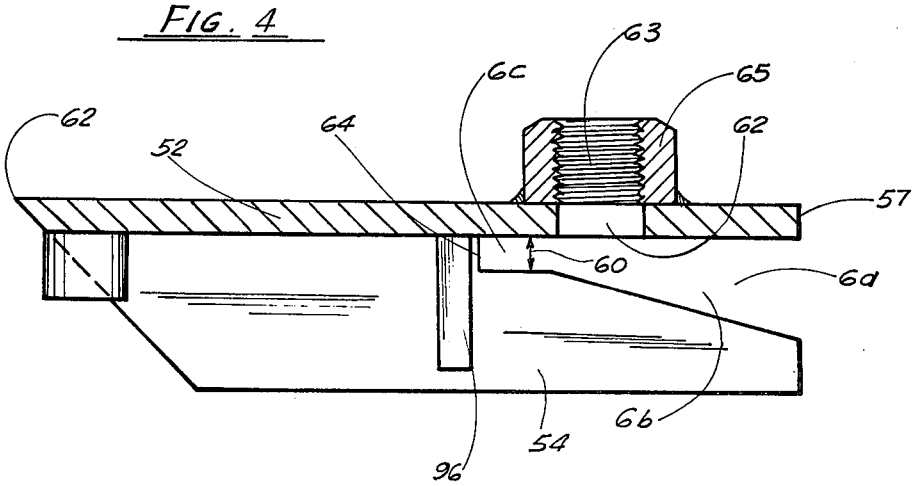
FIG. 5 is a side, cross-sectional view taken along lines 5—5 in FIG. 4.
Figure 6:
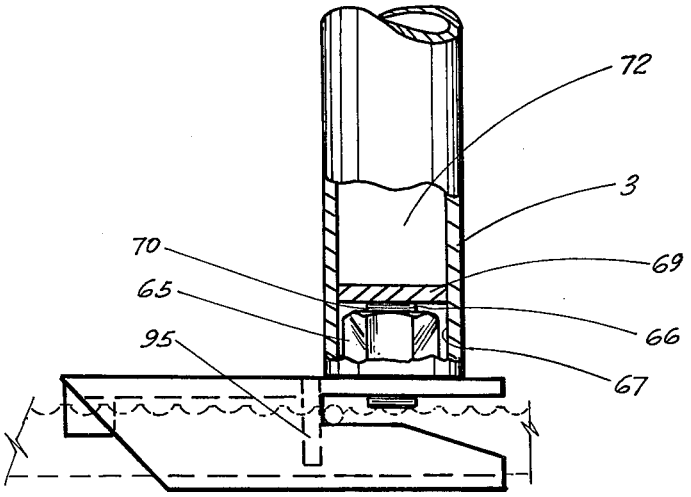
FIG. 6 is a side, partially sectional view of a rail post.

As can be seen in FIG. 2, each rail post 7 which is disposed in surrounding relationship to hole 2 comprises a longitudinally elongated tubular body 3 and a foot portion 4. As best can be seen in FIGS. 2 and 5, foot portion 4 comprises a longitudinally extending length of channel iron having a top surface plate 52 and downwardly extending skirts 53, 54, skirts 53, 54, having slots **6, 6*a*, extending radially inwardly from one outer end 56, 57 thereof, respectively. Slots 6, 6*a*, each have a front portion 6*b* and rear portion 6*c*, front portion 6*b* forming an approximately 15° angle with an imaginary plane parallel to top surface plate 52, rear portion 6*c* being substantially parallel to top surface plate 52. The width 60 of rear portion 6*c* of each slot 6, 6*a* is made to be approximately the same width as cross-member 69 of grating 10. Top surface plate 52 of foot portion 4 has a generally rectangular contour. Skirts 53, 54 have a generally rectangular contour, except that outer end 61, 62 opposite outer ends 56, 57, form an approximately 45° angle with top surface plate 52. In the preferred embodiment of the present invention, foot portion 4 and tubular body 3 of rail post 7** are made of steel, although it is understood that any mechanically strong material can be used.

Figure 3:
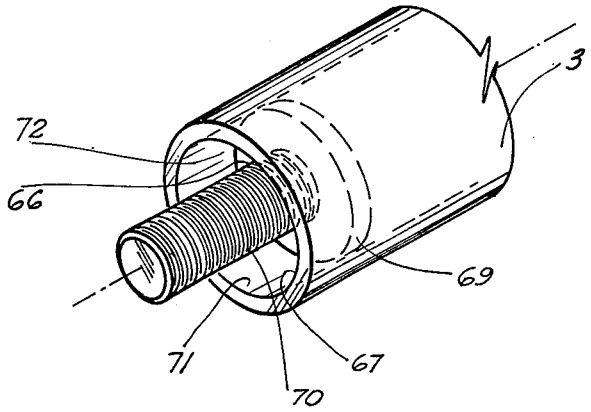
FIG. 3 is a perspective, partially sectional view of the bolt mounted substantially within the bore of the tubular body of a rail post.
Figure 4:
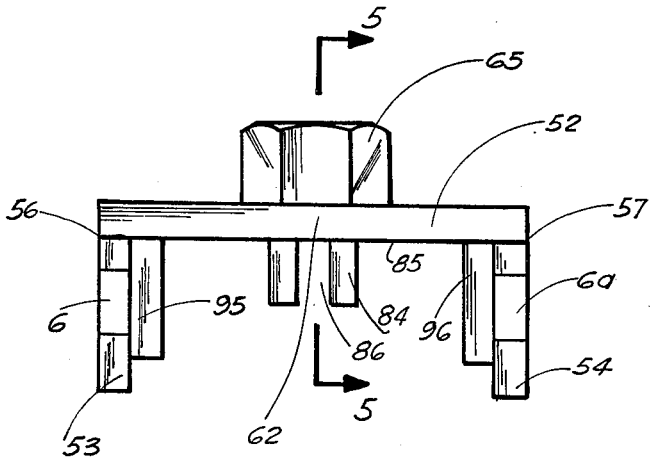
FIG. 4 is a frontal, elevational view of the foot portion of a rail post.

In the preferred embodiment, as best seen in FIG. 5, top surface plate 52 is provided with a machine-threaded aperture 62 at a point near the center of top surface plate 52 substantially near the imaginary plane perpendicular to the termination point 64 of slots 6, 6*a*. Further, as best seen in FIG. 4, a nut 65 is fixably attached, for example, welded, to top surface plate 52, in perfectly coaxial alignment with aperture 62, nut 65 being machine-threaded 63 in the same manner as aperture 62. As best seen in FIG. 3, the head 68 of a bolt 66 is fixably attached, for example, welded, to the inner wall 67 of tubular body 3, the longitudinal axis of bolt 66 being substantially coincidental with the longitudinal axis of tubular body 3. The threaded stud portion 70 of bolt 66 extends downwardly beyond the mouth 71 of bore 72 of tubular body 3, stud portion 70 mating with nut 65, thereby removably, but securably attaching tubular body 3 with foot portion 4. Alternatively, tubular body 3 could be fixably attached, for example, welded to top surface plate 52. However, the advantages of the preferred embodiment over the alternative embodiment will hereinafter be seen. In either embodiment, tubular body 3 is substantially perpendicular to top surface plate 52 of foot portion 4.

Figure 7:
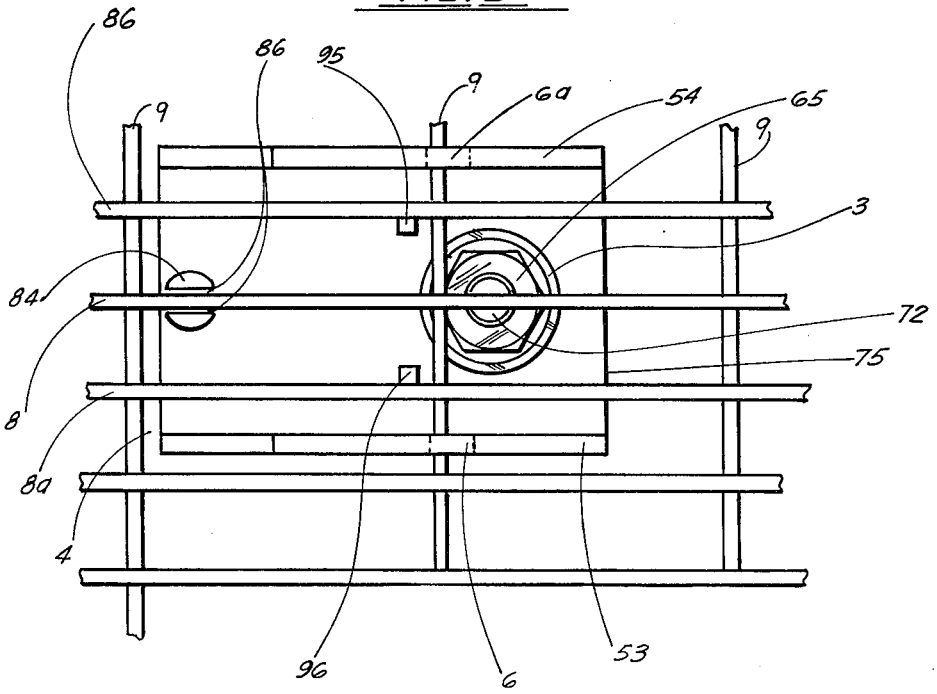
FIG. 7 is a bottom view of the foot portion, shown engaged with the grating.

Now that tubular body 3 and foot portion 4 are connected together, rail post 7 is ready for engagement with grating 10 of the oil rig platform (not shown). In order to engage rail post 7 with grating 10, a workman (not shown) must tilt tubular body 3 downwardly in the direction of outer end 75 of top surface 52 closest to tubular body 3, towards grating 10. Next, the workman must slidably, frictionally engage slot 6, 6*a* with cross-member 9 of grating 10, skirts 53, 54 of foot portion 4 being disposed substantially parallel to run members 8 of grating 10. A solid, cylindrical member 84 is fixably attached, for example, welded, to the bottom surface 85 of top surface plate 52, the horizontal axis of member 84 being substantially coincidental with the horizontal axis of aperture 62. Member 84 is bifurcated by channel 86, as best seen in FIG. 4, and the workman must align channel 86 of member 84 with any run member 8 of grating 10, as best seen in FIG. 7, thereby simultaneously aligning aperture 62 with the same run member 8. The other end 61, 62 of skirts 53, 54 of foot portion 4 are slanted so as to form an approximately 45° angle with top surface plate 52 so that cross-member 9*a* of grating 10 does not impede the engagement of slots 6, 6*a* with cross-member 9 of grating 10. Once front portions 6*b* of slots 6, 6*a* are wholly engaged with cross-member 9, tubular body 3 is titled upwardly until tubular body 3 and foot portion 4 of rail post 7 are substantially perpendicular to grating 10, thereby securely, frictionally, and completly engaging rear portion 6*c* of slots 6, 6*a* with cross-member 9 and channel 86 of member 84 with run member 8 of grating 10, thereby preventing lateral movement of foot portion 4, and thus, tubular body 3, since it is connected thereto. Next, stud portion 70 of bolt 66 is mated with machine-threaded aperture 62 of top surface plate 52, stud portion 70 being frictionally communicative with run member 8, thereby providing an even more secure engagement of rail post 7 with grating 10. Longitudinally extending lands 95, 96 are welded, for example, to the bottom surface 85 of top surface plate 52 in spaced linear relationship to each other, the distance between lands 95, 96 being substantially equivalent to the distance between run members 8*a*, 8*b* as best seen in FIG. 7, thereby ensuring that stud portion 70 of bolt 66 remains frictionally communicative with run member 8; preferably lands 95, 96 are perpendicular to the bottom surface 85 of top surface plate 52. A plurality of other rail posts 7 are similarly engaged with grating 10 in surrounding relationship to hole 2 in any suitable configuration, the configuration being rectangular in the preferred embodiment.

Figure 8:
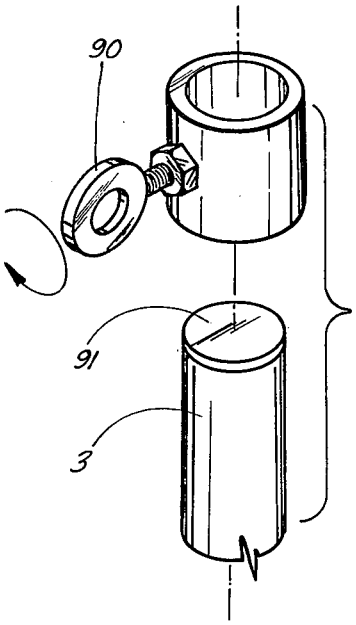
FIG. 8 is an exploded view of the eyelet which is removably attachable with the tubular body of a rail post.

As seen in FIG. 1, a barricade means 13, herein shown as cable 13, or rope 13, is interconnected to each rail post 7, thereby forming an effective barrier to prevent workmen, objects, or the like, from falling into hole 2, thereby preventing injuries or death to workmen, damage to equipment, delays and consequent loss of efficiency in the operation of the oil rig. In the embodiment of the present invention shown in FIG. 1, cable 13, or rope 13, is merely tied through eyelets 90 fixably or removably attached to tubular body 3, as best seen in FIG. 8, near the top 91 thereof, and around rail posts 7. Each rail post 7 can be tied off in any direction. The only way in which rail post 7 can be disengaged, is by turning rail post 7 in a counterclockwise direction until threaded stud portion 70 is no longer frictionally communicative with run member 8, and then tilting rail post 7 radially downwardly in the direction towards outer end 57 of foot portion 4. Also, any other suitable barricade means, for example, a fence, can be employed.

It will be clear to those skilled in the art, that the apparatus of the present invention can be used for many other purposes and in many other contexts, for example, land construction, and that variations and supplementations are anticipated for the invention without departing from the scope thereof. Accordingly, this invention is not to be construed as limited to the particular forms disclosed herein, since these are to be regarded as illustrative rather than restrictive.

What is claimed as invention is:

1. An attachable protective railing device for engagement with grating, having cross members and run members for barricading an area which is desired to be protected, comprising:

(a) a plurality of posts disposed in surrounding relationship to the area to be protected, each said post having a vertically extending upper tubular portion, a channeled foot portion fixedly attached to said upper portion for slidably engaging said grating, said foot portion further comprising a top surface plate and a pair of skirts extending downwardly therefrom, each said skirt having a slot extending radially inwardly from one outer end thereof;

(b) barrier means interconnecting said posts.

2. The apparatus of claim 1, wherein said slots each have a front portion which forms an approximately 15° angle with an imaginary plane parallel to said top surface plate, and a rear portion which is substantially parallel to said top surface plate, the rear portion of each said slot being slightly wider than the cross member of said grating.

3. The apparatus of claim 2, wherein said top surface plate has a generally rectangular contour.

4. The apparatus of claim 3, wherein an end of said skirts opposite said slots forms an 45° angle with said top surface plate.

5. The apparatus of claim 2, wherein said top surface plate is provided with a machine-threaded aperture.

6. The apparatus of claim 5, wherein said upper tubular portion is provided with a bolt at its lower end unitarily comprising a head and a downwardly extending threaded stud portion, wherein said head is fixably attached to the inner walls of said upper tubular portion, the longitudinal axis of said bolt being substantially coincidental with the longitudinal axis of said upper tubular portion, the threaded stud portion of said bolt extending downwardly below the lower end of said bore of said upper tubular portion, said stud portion meeting with said aperture of said top surface plate.

7. The apparatus of claim 6, wherein said top surface plate has a nut fixably attached to its upper surface in coaxial alignment with said aperture, said nut being machine threaded on its inner wall.

8. The apparatus of claim 7, wherein the threaded stud portion of said bolt meets with said nut, thereby removably and securably attaching said upper tubular portion with said foot portion.

9. The apparatus of claim 8, wherein a solid, generally cylindrical member is fixably attached to the bottom surface of said top surface plate, the horizontal axis of said member being substantially coincidental with the horizontal axis of said aperture, said member being bifurcated by a channel, said channel being aligned with a run member of said grating, thereby simultaneously aligning said aperture with the same run member.

10. An attachable/detachable protective railing device for engagement with grating having cross-members and run members, or other similar surfaces for barricading any area which is desired to be protected, comprising:

(a) a plurality of posts disposed in surrounding relationship to any area which is desired to be protected, each said post comprising a longitudinally extending tubular pipe and a channeled foot portion for slidably engaging said grating or other similar surfaces, wherein each said foot portion comprises a longitudinally extending length of channel iron, having a top surface plate and a pair skirts extending downwardly therefrom, each said skirt having a slot extending radially inwardly from one outer end thereof, wherein:

(i) said slots each have a front portion which forms an approximately 15° angle with an imaginary plane parallel to said top surface plate, and a rear portion which is substantially parallel to said top surface plate, the rear portion of each said slot being just wider than the cross-members of said grating;

(ii) said top surface plate has a generally rectangular contour;

(iii) said skirts have a generally rectangular contour, except that the outer end of each skirt opposite said slots, forms an approximately 45° angle with said top surface plate;

(iv) said top surface plate is provided with a machine-threaded aperture;

(v) a bolt unitarily comprising a head and a downwardly extending threaded stud portion is fixably attached to the inner walls of said tubular body, the longitudinal axis of said bolt being substantially coincidental with the longitudinal axis of said tubular body, the threaded stud portion of said bolt extending downwardly beyond the lower end of the bore of said tubular body;

(vi) said top surface plate comprises a nut which is fixably attached to its top surface in coaxial alignment with said aperture, said nut being machine-threaded in the same manner as said aperture, the threaded stud portion of said bolt mating with said nut, thereby removably, but securably attaching said tubular body with said foot portion;

(vii) a solid, generally cylindrical member is fixably attached to the bottom surface of said top surface plate, the horizontal axis of said member being substantially coincidental with the horizontal axis of said aperture, said member being bifurcated by a channel, said channel having a width just greater than the width of said run members and being aligned with a run member of said grating, thereby simultaneously aligning said aperture with the same run member;

(b) barrier means interconnecting said posts.

11. The apparatus of claim 10, wherein it further comprises a pair of longitudinally extending lands fixably attached to the bottom surface of said top surface plate in spaced relationship to each other for ensuring continuous frictional communication between said threaded stud portion of said bolt and said run member.

* * * * *